US010745787B2

(12) United States Patent
Ito et al.

(10) Patent No.: US 10,745,787 B2
(45) Date of Patent: Aug. 18, 2020

(54) COPPER ALLOY SHEET MATERIAL

(71) Applicant: DOWA METALTECH CO., LTD., Tokyo (JP)

(72) Inventors: Tsuyoshi Ito, Tokyo (JP); Kuniaki Miyagi, Tokyo (JP); Hiroto Narieda, Tokyo (JP); Tomotsugu Aoyama, Tokyo (JP); Akira Sugawara, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 82 days.

(21) Appl. No.: 15/760,693

(22) PCT Filed: Aug. 29, 2016

(86) PCT No.: PCT/JP2016/075246
§ 371 (c)(1),
(2) Date: Mar. 16, 2018

(87) PCT Pub. No.: WO2017/047368
PCT Pub. Date: Mar. 23, 2017

(65) Prior Publication Data

US 2018/0274074 A1 Sep. 27, 2018

(30) Foreign Application Priority Data

Sep. 18, 2015 (JP) ..... 2015-184629

(51) Int. Cl.

| | |
|---|---|
| ***C22F 1/08*** | (2006.01) |
| ***C22C 9/00*** | (2006.01) |
| ***C22C 9/02*** | (2006.01) |
| ***H01B 1/02*** | (2006.01) |
| ***H01B 13/00*** | (2006.01) |
| ***H01B 5/02*** | (2006.01) |
| ***C22F 1/00*** | (2006.01) |
| ***C22C 9/04*** | (2006.01) |

(52) U.S. Cl.
CPC ..... *C22F 1/08* (2013.01); *C22C 9/00* (2013.01); *C22C 9/02* (2013.01); *H01B 1/02* (2013.01); *H01B 5/02* (2013.01); *H01B 13/00* (2013.01); *C22C 9/04* (2013.01); *C22F 1/00* (2013.01)

(58) Field of Classification Search
CPC ..... C22F 1/08; C22F 1/00; C22C 9/00; C22C 9/02; C22C 9/04; H01B 1/02; H01B 5/02; H01B 13/00
USPC ..... 148/682
See application file for complete search history.

(56) References Cited

U.S. PATENT DOCUMENTS

| | | | | |
|---|---|---|---|---|
| 5,705,126 | A | 1/1998 | Goto et al. | |
| 2010/0319818 | A1* | 12/2010 | Sawai | C22C 9/00 148/554 |

FOREIGN PATENT DOCUMENTS

| | | |
|---|---|---|
| JP | 08-157985 | 6/1996 |
| JP | 2005-298931 | 10/2005 |
| JP | 2010-126783 | 6/2010 |
| JP | 2010-242177 | 10/2010 |
| JP | 2011-001593 | 1/2011 |
| JP | 2012-012644 | 1/2012 |
| JP | 2012-092368 | 5/2012 |
| JP | 2012-172168 | 9/2012 |
| JP | 2014-208862 | 11/2014 |
| JP | 2015-063741 | 4/2015 |
| WO | 2012/026610 | 3/2012 |

* cited by examiner

*Primary Examiner* — Brian D Walck
(74) *Attorney, Agent, or Firm* — Clark & Brody LP

(57) ABSTRACT

A copper alloy sheet material has a copper alloy component system that has a high conductivity of 75.0% IACS or more and has both high strength and good stress relaxation resistance characteristics. A copper alloy sheet material has a composition containing, by mass %, from 0.01 to 0.50% of Zr, from 0.01 to 0.50% of Sn, a total content of from 0 to 0.50% of Mg, Al, Si, P, Ti, Cr, Mn, Co, Ni, Zn, Fe, Ag, Ca, and B, with the balance Cu, and unavoidable impurities, and a metal structure having a number density $N_A$ Of fine second phase particles having a particle diameter of approximately from 5 to 50 nm of 10.0 per 0.12 $mm^2$ or more and a ratio $N_B/N_A$ of a number density $N_B$ (per 0.012 $mm^2$) of coarse second phase particles having a particle diameter exceeding approximately 0.2 mm and the $N_A$ of 0.50 or less.

2 Claims, No Drawings

COPPER ALLOY SHEET MATERIAL

TECHNICAL FIELD

The present invention relates to a copper alloy sheet material and a method for producing the same.

BACKGROUND ART

In copper alloys, a Cu—Zr based copper alloy has been known as an alloy system having a high conductivity of 75% IACS or more. A Cu—Zr based copper alloy can achieve a strength level with high practical utility (for example, a tensile strength of approximately 450 MPa or more) as a current-carrying component, such as a connector, while retaining the aforementioned high conductivity, by controlling the final degree of working and the like. Furthermore, practical stress relaxation resistance characteristics (for example, a stress relaxation ratio of 25% or less at 200° C. for 1,000 hours) that are practical in various purposes can also be imparted thereto. However, in order to impart simultaneously a high conductivity and high stress relaxation resistance characteristics to the alloy system while enhancing the strength thereof, there have been many restrictions, for example, the contents of the third elements other than Zr are necessarily strictly limited. Therefore, for achieving a copper alloy that has a conductivity, a strength, and stress relaxation resistance characteristics at high levels, for example, a conductivity of 75.0% IACS or more, a tensile strength of 450 MPa or more, and a stress relaxation ratio of 25% or less at 200° C. for 1,000 hours, there have been factors increasing the cost, for example, inexpensive general scraps containing Sn are difficult to use. Moreover, there have been considerable restrictions in the production process.

PTL 1 describes a technique of improving a creep resistance of a copper alloy by combined adding Zr and others. However, the example of an alloy containing Sn added thereto (Example No. 9) has a low conductivity of 43% IACS, and the high conductivity inherent to the Cu—Zr based copper alloy is impaired.

PTL 2 describes a copper alloy improved in Young's modulus and stress relaxation resistance characteristics. The example of an alloy containing Zr and Sn (Example 2-9 of invention shown in Table 2) has a low conductivity of 48.1% IACS and a not so high strength level.

PTL 3 describes a technique of improving a strength and bending workability by subjecting a Cu—Zr based alloy having a high conductivity to a rolling. The example of an alloy containing Zr and Sn (Example No. 2) achieves a conductivity of 86% IACS and a tensile strength of 530 $N/mm^2$. However, there is no teaching about the stress relaxation resistance characteristics. According to the investigations made by the present inventors, sufficient improvement of the stress relaxation resistance characteristics cannot be expected by the measures described in PTL 3 (see Comparative Example 13 shown later).

PTL 4 describes a technique for providing a copper alloy that is difficult to cause deformation of a lead of a lead frame and has a short period of time required for stress relief annealing after a press working. While various elements that are capable of being added are exemplified, there is no specific example of combined addition of Zr and Sn. Furthermore, it is difficult to provide stably a high conductivity of 75.0% IACS by the technique.

PTL 5 describes a technique of providing a high conductivity and a high strength by adding Cr and the third elements, such as Zr and Sn. However, the stress relaxation ratio is from 14 to 19% under condition of 150° C.×1,000 hours, and further improvements thereof are demanded depending on purposes.

PTL 6 describes a technique of improving a bending deflection coefficient of a Cu—Zr—Ti based copper alloy. An example of combined addition of Sn is disclosed (Example 21 of invention in Table 1), but the tensile strength thereof is as low as 386 MPa.

PTL 7 describes a technique of improving bendability and drawability of a Cu—Zr—Ti based copper alloy. An example of combined addition of Sn is disclosed (Example 16 of invention in Table 1), but there is no teaching about improvement of stress relaxation resistance characteristics.

PTL 8 describes a technique of providing high bending workability and a high spring elastic limit for a Cu—Zr based copper alloy by making a structure state with a KAM value of from 1.5 to 1.8° within the crystal grains. However, there is not description about the addition of Sn, and there is not teaching about a measure for enhancing the stress relaxation resistance characteristics.

CITATION LIST

Patent Literatures

PTL 1: JP-A-2005-298931
PTL 2: WO 2012/026610
PTL 3: JP-A-2010-242177
PTL 4: JP-A-2010-126783
PTL 5: JP-A-2012-12644
PTL 6: JP-A-2014-208862
PTL 7: JP-A-2015-63741
PTL 8: JP-A-2012-172168

SUMMARY OF INVENTION

Technical Problem

An object of the invention is to provide a copper alloy sheet material having a copper alloy component system capable of being produced with general scraps of copper based material that has a high conductivity of 75.0% IACS or more and has both a high strength and good stress relaxation resistance characteristics in a well balanced manner.

Solution to Problem

The inventors have found that the aforementioned object can be achieved in such a manner that in a Cu—Zr—Sn based copper alloy with combined addition of Zr and Sn, sufficient strain is introduced to the crystal lattice in a hot rolling process and a cold rolling process, and then an aging treatment is performed under a condition where the strain is not excessively relaxed.

Accordingly, the invention provides a copper alloy sheet material having a chemical composition containing, in terms of percentage by mass, from 0.01 to 0.50% of Zr, from 0.01 to 0.50% of Sn, a total content of from 0 to 0.50% of Mg, Al, Si, P, Ti, Cr, Mn, Co, Ni, Zn, Fe, Ag, Ca, and B, with the balance of Cu, and unavoidable impurities, having a metal structure having a number density $N_A$ of fine second phase particles defined by the following item (A) of 10.0 per 0.12 $\mu m^2$ or more and a ratio $N_B/N_A$ of a number density $N_B$(per 0.012 $mm^2$) of coarse second phase particles defined by the following item (B) and the $N_A$ of 0.50 or less, and having a conductivity of 75.0% IACS or more and a tensile strength in a rolling parallel direction (LD) of 450 MPa or more.

(A) In a view field observed with a TEM (transmission electron microscope) equipped with an EDS (energy dispersive X-ray spectrometer) in a thickness direction of the sheet material, a rectangular observation region of 0.4 μm×0.3 μm (area: 0.12 $\mu m^2$) is randomly provided. Three positions randomly selected in a Cu parent phase within the observation region are subjected to EDS analysis to measure a detected intensity of Zr, and an average Zr detected intensity of the three positions is designated as $I_0$. In granular substances observed as a difference in contrast from the parent phase in the TEM image, all the granular substances that are wholly or partially present in the observation region are subjected to EDS analysis under the same condition as in the measurement of $I_0$, and a number of the granular substances that are measured to have a Zr detected intensity 10 times or more the $I_0$ is counted. The operation is performed for three or more of the rectangular observation regions that do not overlap each other, and a value obtained by dividing the total number counted of the granular substances by the total area of the observation regions is converted to a number per 0.12 $\mu m^2$, which is designated as the number density $N_A$ (per 0.12 $\mu m^2$) of the fine second phase particles.

(B) A rectangular measurement region of 120 μm×100 μm (area: 0.012 $mm^2$) randomly provided in an observation plane in parallel to a sheet material surface (rolled surface) with an FE-EPMA (field emission electron probe micro analyzer) is measured for a fluorescent X-ray detected intensity of Zr (which is hereinafter referred to as a "Zr detected intensity") with a WDS (wavelength dispersive X-ray spectrometer) under an area analysis condition of an acceleration voltage of 15 kV and a step size of 0.2 μm, the Zr detected intensities of the measured spots are expressed by percentage with the maximum value of the Zr detected intensities within the measurement region being 100%, a binary mapping image is obtained with a black spot for the measured spot having a Zr detected intensity that is less than 50% of the maximum value and a white spot for the measured spot having a Zr detected intensity that is 50% or more of the maximum value, and a number of white regions constituted by only one white spot or two or more white spots adjacent to each other is counted, provided that in a case where a black spot is present within a contour of one white region, the black spot is assumed to be a white spot. The operation is performed for three or more of the measurement regions that do not overlap each other, and a value obtained by dividing the total number counted of the white regions by the total area of the measurement regions is converted to a number per 0.012 $mm^2$, which is designated as the number density $N_B$ (per 0.012 $mm^2$) of the coarse second phase particles.

Among the aforementioned component elements, Mg, Al, Si, P, Ti, Cr, Mn, Co, Ni, Zn, Fe, Ag, Ca, and B are arbitrary elements. The total content of Zr and Sn may be, for example, 0.10% by mass or more.

In an observation plane in parallel to the sheet material surface (rolled surface) of the copper alloy sheet material, a KAM (kernel average misorientation) value measured by EBSD (electron backscatter diffractometry) at a step size of 0.2 μm within a crystal grain with a boundary having a crystallographic orientation difference of 15° or more being assumed to be a crystal grain boundary may be a value in a range of from 1.5 to 4.5°. The KAM value corresponds to an average value that is obtained in such a manner that for electron beam-irradiated spots disposed on the surface of the measurement region with an interval of 0.2 μm, all the crystallographic orientation differences between the adjacent spots (which are hereinafter referred to as "adjacent spots orientation differences") are measured, and the measured values of the adjacent spots orientation differences that are less than 15° are extracted and averaged. Therefore, the KAM value is an index showing the amount of the lattice strain within the crystal grain, and a larger value thereof can be evaluated as a material having large crystal lattice strain.

The invention also provides, as a method for producing the aforementioned copper alloy sheet material, a method for producing a copper alloy sheet material, containing:

heating a slab of a copper alloy having the aforementioned chemical composition to from 850 to 980° C., and then starting to subject the material to hot rolling under a condition of a final rolling pass temperature of 450° C. or less and a rolling reduction ratio in a temperature range of from 550° C. to 250° C. of 50% or more, thereby providing a hot rolled material (a hot rolling step);

subjecting the hot rolled material to cold rolling with a total rolling reduction ratio of 90% or more in such a manner that intermediate annealing is not inserted, or intermediate annealing is inserted once or more at a temperature causing no recrystallization, thereby providing a cold rolled material (a cold rolling step); and heating the cold rolled material to a temperature range of from 280 to 650° C. to precipitate second phase particles, thereby providing an aged material having a conductivity of 75.0% IACS or more and a tensile strength of 450 MPa or more (an aging treatment step).

Advantageous Effects of Invention

According to the invention, a copper alloy sheet material that has a conductivity of 75.0% IACS or more and has both a high strength of a tensile strength of 450 MPa or more and excellent stress relaxation resistance characteristics in a well balanced manner can be provided with a Cu—Zr—Sn based copper alloy. The conductivity can be controlled to 80.0% IACS or more. The copper alloy sheet material contains Sn as an essential component, and allows inclusion of various elements that are liable to be mixed from copper alloy scraps, and therefore general copper alloy scraps can be frequently used as a starting material. The copper alloy sheet material can be produced through a simple process performing sequentially melting and casting, hot rolling, cold rolling, and aging. Furthermore, in the Cu—Zr—Sn based copper alloy, the oxide film formed in the hot rolling is densified as compared to a Cu—Zr based copper alloy having no Sn added, so as to suppress the internal oxidation of Zr in the surface portion of the hot rolled material, and thus the facing amount after the hot rolling can be reduced, which leads to enhancement of the material yield. Consequently, the invention can provide a sheet material having capabilities that are equivalent to or higher than the ordinary Cu—Zr based copper alloy sheet material, at lower cost.

DESCRIPTION OF EMBODIMENTS

Chemical Composition

In the following description, "%" in the chemical compositions means "% by mass" unless otherwise indicated.

In the invention, a Cu—Zr—Sn based copper alloy with combined addition of Zr and Sn is applied.

Zr is precipitated as the second phase at the crystal grain boundaries of the Cu phase, which is the matrix (metal base material), and is considered to act advantageously on enhancement of the strength and the stress relaxation resistance characteristics. The Zr-containing phase is considered to be formed mainly of $Cu_3Zr$. In the invention, by adding Sn and by applying the production condition described later, precipitation of the Zr-containing phase is accelerated also in the crystal grains, so as to achieve further enhancement of the strength and the stress relaxation resistance characteristics.

Sn is solid-dissolved in the Cu phase to impart strain in the crystal grains, which contributes to enhancement of the strength, and in addition, the oxide film formed in the hot rolling is densified thereby, so as to suppress the internal oxidation of Zr. Furthermore, it has been found that by applying the production condition described later, a large amount of strain can be accumulated around the solid-dissolved Sn atoms, and can function as sites for precipitating Zr, which is originally an element of the grain boundary precipitation type, within the crystal grains. The present inventors are considering the mechanism therefor as follows at the present time. Specifically, the addition of Sn forms a state where the Cottrell atmosphere with Sn atoms is liable to occur in many portions within the crystal grains. When strain is introduced to the matrix in the hot rolling step by achieving the prescribed rolling reduction within a low temperature range where no dynamic recrystallization occurs, the working strain (dislocation) is fixed to the Cottrell atmosphere formed by the solid-dissolved Sn atoms, and the portions with the fixed dislocation function as sites for precipitation of Zr. A structure state where the Zr-containing second phase is finely dispersed not only at the grain boundaries but also at the positions originated from the aforementioned sites in the crystal grains can be obtained, and thereby retention of the conductivity, enhancement of the strength, and enhancement of the stress relaxation resistance characteristics can be simultaneously achieved.

For providing the aforementioned function, it is necessary that Zn is contained in an amount of 0.01% or more, and Sn is contained in an amount of 0.01% or more. The total content of Zr and Sn is preferably 0.10% or more. However, the addition of Zr in a too large amount may cause reduction of the hot rolling workability, and thus the content of Zr is preferably in a range of 0.50% or less. The addition of Sn in a too large amount may cause accumulation of excessive strain, which may lead to reduction of the conductivity, and thus the content of Sn is preferably in a range of 0.50% or less.

Mg and Al are solid-dissolved in the Cu phase to provide a function enhancing the strength and the stress relaxation resistance characteristics, and thus may be contained depending on necessity. In this case, the content of Mg is more effectively in a range of from 0.01 to 0.10%. The content of Al is more effectively in a range of from 0.01 to 0.10%.

Ni and P form precipitates to contribute to enhancement of the strength, and thus may be contained depending on necessity. In this case, the content of Ni is preferably in a range of from 0.03 to 0.20%. The content of P is preferably in a range of from 0.01 to 0.10%. The combined addition of Ni and P is more effective.

Ti and Si form precipitates to contribute to enhancement of the strength as similar to Ni and P described above, and thus may be contained depending on necessity. In this case, the content of Ti is preferably in a range of from 0.03 to 0.20%. The content of Si is preferably in a range of from 0.01 to 0.10%. The combined addition of Ti and Si is more effective.

Cr is an element of the intragranular precipitation type, and the addition thereof in combination with Zr miniaturizes the precipitations of both of them through the mutual interaction. The refinement of the precipitations is effective for enhancement of the strength and the stress relaxation resistance characteristics. Therefore, Cr may be contained depending on necessity. In the case where Cr is contained, the content thereof is more effectively in a range of from 0.01 to 0.10%.

In addition, Mn, Co, Zn, Fe, Ag, Ca, B, and the like may be contained.

The total content of Mg, Al, Si, P, Ti, Cr, Mn, Co, Ni, Zn, Fe, Ag, Ca, and B is preferably in a range of 0.50% or less. An excessive amount of these elements contained may be a factor decreasing the hot workability and decreasing the conductivity due to excessive strain.

Metal Structure

In the invention, the strength and the stress relaxation resistance characteristics are simultaneously improved by the precipitation of the fine second phase particles and the introduction of the crystal lattice strain (such as dislocation).

Fine Second Phase Particles

The number density $N_A$ of the fine second phase particles defined by the item (A) is necessarily 10.0 per 0.12 $\mu m^2$ or more, and more preferably 20.0 per 0.12 $\mu m^2$ or more. The upper limit of the number density $N_A$ may not be particularly limited, and is generally in a range of 100 per 0.12 $\mu m^2$ or less. The fine second phase particles are formed mainly of a Cu—Zr based compound and has a particle diameter (i.e., the diameter of the longest portion of the particles in a TEM observation image) in a range of approximately from 5 to 50 nm. The fine second phase particles of this type are originally a compound of the grain boundary precipitation type, but according to the invention, are also precipitated at the Sn atom solid dissolved sites in the crystal grains. Consequently, the copper alloy sheet material according to the invention has the unique structure state, in which the Cu—Zr based fine second phase particles, which are originally of the grain boundary precipitation type, are dispersed in the crystal grains, and the dispersion mode of the fine second phase particles contributes to enhancement of the strength and the stress relaxation resistance characteristics.

Coarse Second Phase Particles

The coarse second phase particles identified by the item (B) are formed mainly of a Cu—Zr based compound, and have a particle diameter (i.e., the diameter of the longest portion of the particles in a SEM observation image) of approximately 0.2 μm or more, and most of the particles have a particle diameter in a range of from 0.2 to 5 μm. Most of the coarse second phase particles of this type are present at the crystal grain boundaries, and have a smaller effect of enhancing the strength and the stress relaxation resistance characteristics than the fine second phase particles dispersed in the crystal grains. In particular, the coarse particles having a particle diameter exceeding 0.2 μm substantially do not contribute to enhancement of the strength. Therefore, the amount of the coarse second phase particles present is preferably as small as possible. Specifically the number density $N_B$ of the coarse second phase particles is preferably in a range of from 0 to 50.0 per 0.012 $mm^2$.

Ratio $N_B/N_A$

In the case where the ratio of the number density $N_B$(per 0.012 $mm^2$) of the coarse second phase particles and the number density $N_A$ (per 0.12 $\mu m^2$) of the fine second phase particles, i.e., $N_B/N_A$, is increased, the accumulation of the crystal lattice strain, which is evaluated by the KAM value described later, tends to be insufficient even though the number density $N_A$ of the fine second phase particles is sufficiently ensured in the aforementioned prescribed range, and thereby it may be difficult to achieve stably both a high strength and good stress relaxation resistance characteristics. As a result of various investigations, the ratio $N_B/N_A$ is preferably 0.50 or less, and more preferably 0.20 or less.

KAM Value

In the invention, the effect of enhancing the strength and the stress relaxation resistance characteristics is obtained with the unique structure state, in which the Cu—Zr based precipitated phase, which is originally of the grain boundary precipitation type, is finely dispersed in the crystal grains. For achieving the precipitation mode, it is necessary that Sn liable to form the Cottrell atmosphere is contained, and strain is introduced, thereby preparing the Zr precipitation sites in the crystal grains. Therefore, the introduction of strain is utilized as a measure for invoking the precipitation of the fine second phase particles in the crystal grains. However, it is difficult to enhance the strength and the stress relaxation resistance characteristics in a well balanced manner only by dispersing the fine second phase particles simply in a large amount in the crystal grains. In addition to the dispersion of the fine second phase particles in the crystal grains, it is important that appropriate crystal lattice strain is provided, i.e., the matrix is not excessively softened, after the aging treatment. In the case where finally the number density $N_A$ of the fine second phase particles is 10.0 per 0.12 $\mu m^2$ or more, and the tensile strength in the rolling direction is retained to 450 MPa or more, it can be judged that a structure state having appropriate crystal lattice strain is provided. As another index for evaluating quantitatively the distribution state of the crystal lattice strain, the KAM value can be exemplified. According to the investigations by the inventors, for achieving both a tensile strength of 450 MPa or more and stress relaxation ratio of 25% or less at 200° C. for 1,000 hours for the alloy, the KAM value (described above) measured at a step size of 0.2 μm within the crystal grain with a boundary having a crystallographic orientation difference of 15° or more being assumed to be the crystal grain boundary is preferably from 1.5 to 4.5°, and more preferably from 1.8 to 4.0°.

Characteristics

Conductivity

In the invention, a copper alloy sheet material having a conductivity of 75.0% IACS is applied, and a copper alloy sheet material having a conductivity of 80.0% IACS is more preferably applied.

Tensile Characteristics

In the invention, a copper alloy sheet material having a tensile strength in the rolling parallel direction (LD) of 450 MPa or more is applied. A material having this strength level may have practical utility as a current-carrying component, such as a connector. A material controlled to have 480 MPa or more, or 500 MPa or more may also be provided. In consideration of the balance with the other characteristics, the tensile strength in LD thereof is preferably controlled to a range of 550 MPa or less, and may be managed to 540 MPa or less. The 0.2% offset yield strength in LD thereof is preferably from 400 to 500 MPa. The breaking elongation thereof is preferably 3.0% or more.

Bending Workability

In the 90° W bending test described in JIS H3110:2012, the value of the ratio MBR/t of the minimum bending radius MBR that does not cause cracking in the case where the bending axis is in the rolling parallel direction (B.W.) and the thickness t is preferably 0.5 or less. In the case where the ratio MBR/t in the bending test is 0.5 or less, it can be judged that the practical workability to a current-carrying component, such as a connector, is provided.

Stress Relaxation Resistance Characteristics

In the evaluation method for the stress relaxation resistance characteristics described later, the stress relaxation ratio in the case where a test piece having a longitudinal direction agreeing with the rolling direction (LD) is retained at 200° C. for 1,000 hours is preferably 25.0% or less. In the case where the stress relaxation ratio in the test is 25.0% or less, it can be judged that the practical stress relaxation resistance characteristics that are practical in various purposes, to which a copper alloy having a conductivity of 75.0% IACS or more is applied, are provided.

Production Method

The Cu—Zr—Sn based copper alloy sheet material having the aforementioned characteristics can be produced through a simple process performing melting and casting, hot rolling, cold rolling, and aging in this order.

After the hot rolling, facing may be performed depending on necessity, and before the cold rolling and after the aging, acid cleaning and polishing, and further degreasing may be performed depending on necessity. The process steps will be described below.

Melting and Casting

A slab may be produced by continuous casting, semi-continuous casting, or the like. For preventing oxidation of Zr and the like, the process is preferably performed in an inert gas atmosphere or in a vacuum melting furnace.

Hot Rolling

The slab is charged in a heating furnace and heated to from 850 to 980° C. When the heating temperature is less than 850° C., the coarse Cu—Zr based second phase in the cast structure may be insufficiently dissolved to make the coarse second phase particles remaining, and as a result, it may be difficult to enhance finally the strength and the stress relaxation resistance characteristics in a well balanced manner. When the heating temperature exceeds 980° C., the strength of the portion having a low melting point in the cast structure may be considerably decreased to cause hot working cracking. The retention time at the temperature range (i.e., the period of time where the material temperature is in the temperature range) is preferably 30 minutes or more.

The slab thus heated is taken out from the furnace, and then hot rolling is started. In general, hot rolling of a copper alloy is performed in a temperature range where the additional elements are solid-dissolved. For the Cu—Zr based copper alloy, even in the case where a heating profile where the hot rolling ends at a high temperature range is employed, good stress relaxation resistance characteristics may be achieved by such measures as a method of repeating cold rolling and a heat treatment in the subsequent step. However, for the copper alloy composition with combined addition of Zr and Sn, in the case where not only good stress relaxation resistance characteristics are targeted, but also a high strength is simultaneously targeted, it is difficult to provide good results by employing the general hot rolling condition.

As a result of various investigations by the inventors, it has been found that it is considerably effective that in the hot rolling step, a sufficient reduction is performed to introduce working strain in a temperature range where the dynamic recrystallization is difficult to occur, and Zr can be precipitated as the second phase. Specifically, in the copper alloy composition having Sn, which is liable to form the Cottrell atmosphere through solid dissolution in the crystal grains, added thereto along with Zr, the strain (such as dislocation) introduced in a low temperature range where dynamic recrystallization is difficult to occur is accumulated in the vicinity of Sn atoms. The strain accumulated portions of this type form regions with a mismatched crystal lattice like the crystal grain boundaries in the crystal grains, and are considered to be sites where Zr, which is originally an element of the grain boundary precipitation type, is liable to be precipitated. In the case where the introducing operation of strain is performed in the Zr precipitation temperature range, the formation reaction of the second phase is facilitated by utilizing the imparted strain energy, and Zr is precipitated not only at the crystal grain boundaries, but also in the strain accumulated portions in the crystal grains selected as the precipitation sites. Consequently, the material after completing the hot rolling (i.e., the hot rolled material) shows a structure state where a part of Zr added is dispersed as fine second phase particles in the crystal grains, and the structure state contributes to simultaneous enhancement of the strength and the stress relaxation resistance characteristics.

Specifically, in the case of the Cu—Zr—Sn based copper alloy controlled to have the aforementioned chemical composition according to the invention, it has been found that it is considerably effective that the hot rolled material is obtained with a final rolling pass temperature of 450° C. or less and a rolling reduction ratio in a temperature range of from 550° C. to 250° C. of 50% or more. When the final rolling pass temperature is too low, the deformation resistance may be increased, and the temperature may be outside the Zr precipitation temperature range, and thus the final rolling pass temperature is preferably 250° C. or more. In the case where the final rolling pass temperature is in a range of 450° C. or less and 250° C. or more, the total rolling reduction ratio at 550° C. or less may be 50% or less.

The rolling reduction ratio from a certain thickness $h_0$ (mm) to another thickness $h_1$ (mm) is determined by the following expression (1) (which is the same as in cold rolling in the subsequent step).

$$\text{Rolling reduction ratio } R\ (\%)=(h_0-h_1)/h_0\times 100 \quad (1)$$

The rolling temperatures in the rolling passes each may be the surface temperature of the material immediately before entering into the working rolls of the rolling pass in the rolling machine.

In a temperature range with a material temperature exceeding 550° C., an appropriate pass schedule may be set corresponding to the size of the slab and the scale of the hot rolling machine in such a manner that a rolling reduction ratio of 50% or more at 550° C. or less can be targeted. In general, after the slab thus heated is taken out from the furnace, the hot rolling is started, and the total rolling reduction ratio in the hot rolling may be, for example, in a range of from 75 to 95%.

In the description herein, the sequence of rolling passes performed by using a hot rolling equipment after taking out from the heating furnace, including rolling at a low temperature range where dynamic recrystallization is difficult to occur, is referred to as hot rolling.

Cold Rolling

The hot rolled material thus obtained above is subjected to cold rolling with a total rolling reduction ratio of 90% or more in such a manner that intermediate annealing is not inserted, or intermediate annealing is inserted once or more at a temperature causing no recrystallization. Strain has been introduced to the hot rolled material since the rolling in the hot rolling is performed in a temperature range where dynamic recrystallization is difficult to occur. In the cold rolling, a further large amount of strain is accumulated. The strain thus accumulated contributes to enhancement of the strength. The upper limit of the rolling reduction ratio in the cold rolling step may be set corresponding to the capability of the rolling machine and the target thickness, and is generally 98% or less in terms of total rolling reduction ratio. In the case where intermediate annealing is not inserted, the rolling reduction ratio may be managed to be 95% or less. The thickness after the cold rolling may be, for example, from 0.1 to 1.0 mm.

In the case where intermediate annealing is inserted during the cold rolling step, the intermediate annealing is performed under condition that does not cause recrystallization for preventing the structure state formed in the hot rolling step (i.e., the structure state where Zr is finely precipitated as the second phase at the strain accumulated portions in the crystal grains) from being broken. The heating temperature of the intermediate annealing is preferably, for example, from 200 to 500° C. In the case where the intermediate annealing inserted, the total rolling reduction ratio is also 90% or more. For example, in the case where the intermediate annealing is inserted once, and the cold rolling is performed from the thickness $h_0$ to the thickness $h_1$ through the process including 90% rolling, intermediate annealing, and 70% rolling, $h_1=h_0\times 0.1\times 0.3=0.03h_0$ is established, and the total rolling reduction ratio is $(h_0-0.03h_0)/h_0\times 100=97\%$ according to the expression (1).

The cold rolling step that does not include intermediate annealing is preferably applied from the standpoint of the production cost.

Aging Treatment

The cold rolled material thus obtained above is heated to a temperature range of from 280 to 650° C. to precipitate the second phase particles, thereby providing an aged material having a conductivity of 75.0% IACS or more, or 80.0% IACS or more, and a tensile strength of 450 MPa or more. In the aging treatment, Zr that is unprecipitated but is solid-dissolved in the matrix and the other precipitation elements are sufficiently precipitated, so as to perform enhancement of the conductivity, enhancement of the stress relaxation resistance characteristics, and further enhancement of the strength in case possible. However, in the aging treatment, atomic diffusion tends to occur in the direction, in which the strain having been accumulated before the aging treatment is released. The release of the strain (including the progress of the recrystallization) leads to reduction of the strength, but the further aging precipitation leads to enhancement of the strength. Therefore, in the aging treatment, there are a case where the strength is finally enhanced and a case where the strength is slightly reduced, depending on the heating temperature and the heating retention time. The suitable aging treatment condition may also vary depending on the chemical composition. Such an aging condition may be employed depending on the chemical composition that the material after aging (i.e., the aged material) has a conductivity of 75.0% IACS or more and a tensile strength of 450 MPa or more. The conductivity may be managed to be 80.0% IACS or more. The optimum condition may be found in a range where the maximum achieving temperature is from 280 to 650° C. The optimum condition corresponding to the composition may be determined in advance by a preliminary experiment.

The temperature range where Zr is actively precipitated is in a range of approximately 280° C. or more, and therefore heating to 280° C. or more is necessary. The heating to 290° C. or more is more preferred. Examples of the aging precipitation elements other than Zr include Mg, Si, Ti, Cr, Co, Ni, and Fe among the aforementioned component elements. In the case where the total content of the aging precipitation elements other than Zr is as small as from 0 to 0.01% (including non-addition), for example, such conditions may be employed as a condition where the maximum achieving temperature is from 280 to 420° C., and the retention time at 280° C. or more is from 1 to 10 hours, or a condition where the maximum achieving temperature is more than 420° C. and 650° C. or less, and the retention time in the temperature range is from 1 minute to 1 hour. In the case where the content of Cr is 0.05% or more, for example, such conditions may be employed as a condition where the maximum achieving temperature is from 280 to 550° C., and the retention time at 280° C. or more is from 1 to 10 hours, or a condition where the maximum achieving temperature is more than 550° C. and 650° C. or less, and the retention time in the temperature range is from 1 minute to 1 hour. The precipitation of Cr proceeds around 500° C., and therefore the precipitation that balances out the release of strain (including the recrystallization) can be performed by retaining the high temperature.

Through the aforementioned process, a copper alloy sheet material that has an excellent conductivity of 75.0% IACS or more, or 80.0% IACS or more, and has both a high strength and high stress relaxation resistance characteristics in a well balanced manner can be provided.

After the aging treatment, cold rolling may be further performed for reinforcement depending on necessity.

EXAMPLES

Copper alloys having the compositions shown in Table 1 were melted and cast with a vertical semi-continuous casting machine. The resulting slabs each were charged in a heating furnace and heated to and retained at the temperature shown in Table 2. The heating retention time (i.e., the period of time where the material temperature is in a temperature range of 900° C. or more, or in the examples with a heating temperature of less than 900° C., the period of time where the material was retained at that temperature) was from 1 minute to 1 hour. The slab after heating was taken out from the furnace, and hot rolling thereof was started with a hot rolling machine. Except for some of Comparative Examples (Nos. 21, 31, and 32), the queuing time between the passes in a high temperature range exceeding 550° C. was controlled to ensure a rolling reduction ratio of 50% or more in a temperature range of 550° C. or less. Table 2 shows the final rolling pass temperature, the total rolling reduction ratio in the hot rolling step, the rolling reduction at from 550° C. to 250° C. (for the examples where the final rolling pass temperature was from 550 to 250° C., the rolling reduction in the rolling passes at from 550° C. to the final rolling pass temperature), and the rolling reduction at less than 250° C. In the hot rolling step, the total rolling reduction ratio was from 75 to 95%, the number of rolling passes at 550° C. or less was from 3 to 10 passes, and the thickness after the final rolling pass was from 2 to 10 mm. In Comparative Example where the material was cracked during the hot rolling (No. 34), the production process was terminated at that time. The rolling temperatures in the passes were monitored by measuring the surface temperature of the material with a radiation thermometer on the entrance side of the working rolls of the hot rolling machine. After the hot rolling, the material was faced to remove the oxide scale to prepare a hot rolled material for subjecting to the subsequent process step.

In some of the examples (Examples of Invention Nos. 1 to 3 and Comparative Examples Nos. 30 and 31), a specimen was collected from the material before the facing, and the thickness of the oxide film formed on the surface of the hot rolled sheet was measured in the following manner.

Measurement of Thickness of Oxide Film

A specimen was cut out from the hot rolled sheet having the surface that was not treated after the hot rolling, and the thickness thereof was measured with a micrometer and designated as $t_0$ (mm). Subsequently, one of the rolled surfaces was ground until the oxide film disappeared with waterproof abrasive paper of No. 150 (with a grain size of P150 defined in JIS R6010:2000) using a rotary grinder, and the thickness thereof after grinding was measured with a micrometer and designated as $t_1$ (mm). The difference between $t_0$ and $t_1$ (i.e., $t_0-t_1$) was calculated and designated as the thickness of the oxide film (mm) of the specimen.

The results are shown in Table 5.

The hot rolled materials each were subjected to cold rolling with the total rolling reduction ratios shown in Table 2, thereby providing cold rolled materials having a thickness of from 0.15 to 1.0 mm. In some of the examples (Example of Invention No. 10 and Comparative Examples Nos. 32 and 33), intermediate annealing was inserted once during the cold rolling step. In the other examples, the cold rolling step was completed without intermediate annealing inserted. For the examples having the intermediate annealing inserted, the production conditions are shown in the margin of Table 2. The metal structure after the intermediate annealing was observed with an optical microscope for confirming the presence of recrystallized particles. Subsequently, the cold rolled materials each were subjected to an aging treatment under the conditions shown in Table 2. The heating profile employed herein was that the material was heated to the temperature shown in Table 2, and then retained at that temperature for the period of time shown in Table 2, followed by cooling. The atmosphere in heating was a mixed gas atmosphere of hydrogen and nitrogen, or an inert gas atmosphere. After the aging treatment, acid cleaning was performed, and the resulting aged materials were used as test materials. The thicknesses of the test materials are shown in Table 2.

TABLE 1

| | | Chemical composition (% by mass) | | | |
|---|---|---|---|---|---|
| Class | No. | Cu | Zr | Sn | Others |
| Example of Invention | 1 | balance | 0.10 | 0.15 | — |
| | 2 | balance | 0.03 | 0.17 | — |
| | 3 | balance | 0.42 | 0.05 | — |
| | 4 | balance | 0.10 | 0.12 | Mg: 0.05 |
| | 5 | balance | 0.03 | 0.45 | Al: 0.04, Mn: 0.02 |
| | 6 | balance | 0.10 | 0.03 | Ni: 0.08, P: 0.02 |
| | 7 | balance | 0.10 | 0.05 | Cr: 0.30, Co: 0.02 |
| | 8 | balance | 0.10 | 0.10 | Zn: 0.05 |
| | 9 | balance | 0.10 | 0.10 | Ti: 0.08, Si: 0.02 |
| | 10 | balance | 0.10 | 0.15 | — |
| Comparative Example | 21 | balance | 0.10 | 0.15 | — |
| | 22 | balance | 0.15 | 0.10 | — |
| | 23 | balance | 0.10 | 0.15 | — |
| | 24 | balance | 0.10 | 0.10 | Mg: 0.05 |
| | 25 | balance | 0.10 | 0.13 | Ti: 0.02 |
| | 26 | balance | 0.03 | 0.60 | — |
| | 27 | balance | 0.10 | 0.05 | Zn: 0.7 |
| | 28 | balance | 0.008 | 0.15 | Ni: 0.10, P: 0.04 |
| | 29 | balance | 0.13 | 0.08 | — |
| | 30 | balance | 0.10 | — | — |
| | 31 | balance | 0.10 | — | — |
| | 32 | balance | 0.15 | 0.05 | — |
| | 33 | balance | 0.10 | 0.15 | — |
| | 34 | balance | 0.60 | 0.02 | — |

Underlined values: outside the scope of the invention

TABLE 2

| Class | No. | Hot rolling: Heating temperature (° C.) | Hot rolling: Final rolling pass temperature (° C.) | Hot rolling: Rolling reduction ratio (%) 550-250° C. | Hot rolling: Rolling reduction ratio (%) Less than 250° C. | Hot rolling: Total rolling reduction ratio (%) | Cold rolling Total rolling reduction ratio (%) | Aging treatment: Temperature (° C.) | Aging treatment: Time | Final thickness (mm) |
|---|---|---|---|---|---|---|---|---|---|---|
| Example of Invention | 1 | 970 | 382 | 65 | 0 | 75 | 90 | 350 | 5 h | 0.5 |
| | 2 | 900 | 330 | 65 | 0 | 75 | 92 | 300 | 7 h | 0.45 |
| | 3 | 970 | 368 | 75 | 0 | 90 | 95 | 415 | 5 h | 0.4 |
| | 4 | 950 | 342 | 75 | 0 | 90 | 95 | 350 | 5 h | 0.4 |
| | 5 | 980 | 278 | 85 | 0 | 90 | 90 | 350 | 5 h | 0.2 |
| | 6 | 950 | 269 | 85 | 0 | 90 | 90 | 300 | 5 h | 0.2 |
| | 7 | 950 | 274 | 90 | 0 | 95 | 90 | 500 | 5 h | 0.2 |
| | 8 | 950 | 355 | 65 | 0 | 75 | 90 | 600 | 1 min | 1.0 |
| | 9 | 950 | 352 | 75 | 0 | 90 | 90 | 400 | 5 h | 1.0 |
| | 10 | 950 | 356 | 75 | 0 | 90 | 97 (*1) | 350 | 2 h | 0.15 |
| Comparative Example | 21 | 950 | 600 | 0 | 0 | 75 | 90 | 400 | 1 h | 0.5 |
| | 22 | 800 | 264 | 65 | 0 | 75 | 90 | 300 | 5 h | 0.5 |
| | 23 | 950 | 350 | 65 | 0 | 75 | 80 | 350 | 5 h | 0.5 |
| | 24 | 950 | 348 | 65 | 0 | 75 | 90 | 250 | 10 h | 0.5 |
| | 25 | 950 | 221 | 25 | 50 | 75 | 90 | 400 | 2 h | 0.5 |
| | 26 | 980 | 281 | 85 | 0 | 90 | 90 | 400 | 5 h | 0.2 |
| | 27 | 980 | 276 | 85 | 0 | 90 | 90 | 350 | 5 h | 0.2 |
| | 28 | 950 | 296 | 85 | 0 | 90 | 90 | 300 | 5 h | 0.2 |
| | 29 | 950 | 362 | 65 | 0 | 75 | 90 | 450 | 1 h | 0.5 |
| | 30 | 950 | 391 | 65 | 0 | 75 | 90 | 350 | 2 h | 0.5 |
| | 31 | 800 | 580 | 0 | 0 | 75 | 97 | 400 | 30 min | 0.15 |
| | 32 | 950 | 642 | 0 | 0 | 75 | 97 (*2) | 450 | 1 min | 0.15 |
| | 33 | 950 | 346 | 65 | 0 | 75 | 97 (*3) | 350 | 2 h | 0.15 |
| | 34 | 980 | | (cracked) | | | — | — | — | — |

(*1) 90% cold rolling → 300° C. × 5 h → 70% cold rolling
(*2) 90% cold rolling → 700° C. × 1 min → 70% cold rolling
(*3) 70% cold rolling → 600° C. × 1 h → 90% cold rolling The test materials (thickness: 0.15 to 1.0 mm) each were measured as follows.

Number Density $N_A$ of Fine Second Phase Particles

The number density $N_A$ of the fine second phase particles was obtained in the manner of the item (A). The TEM used was JEM-2010, produced by JEOL, Ltd., and a region of 0.4 μm×0.3 μm (area: 0.12 $\mu m^2$) irradiated with an electron beam of an acceleration voltage of 200 kV and a beam diameter of 5 nm was observed as a bright field image. The total area of the observed regions was 0.36 $\mu m^2$ (three view fields).

Number Density $N_B$ of Fine Second Phase Particles

The number density $N_B$ of the coarse second phase particles was obtained in the manner of the item (B). The FE-EPMA used was JXA-8530F, produced by JEOL, Ltd. The one rectangular measurement region had a size of 120 μm×100 μm (0.012 $mm^2$), and the total area of the measurement regions was 0.036 $mm^2$ (three view fields).

Ratio $N_B/N_A$

The ratio $N_B/N_A$ was obtained by dividing the value $N_B$ by the value $N_A$.

KAM Value

The KAM value measured at a step size of 0.2 μm within the crystal grain with a boundary having a crystallographic orientation difference of 15° or more being assumed to be the crystal grain boundary was obtained by EBSD (electron backscatter diffractometry) by using FE-SEM (field emission scanning electron microscope, SC-200, produced by TSL Solutions Co, Ltd.). The KAM value was an average value that was obtained in such a manner that for electron beam-irradiated spots disposed on the surface of the measurement region with an interval of 0.2 μm, all the crystallographic orientation differences between the adjacent spots (hereinafter referred to as "adjacent spots orientation differences") were measured, and the measured values of the adjacent spots orientation differences that were less than 15° were extracted and averaged. With the measurement region of 120 μm×100 μm, the KAM values obtained for three measurement regions per one test material were averaged, and the average value was used as the KAM value of the test material.

Conductivity

The test materials each were measured for conductivity according to JIS H0505.

Tensile Strength

A tensile test piece in LD (JIS No. 5) was collected from each of the test materials and subjected to a tensile test of JIS Z2241 with a number of tests n of 3, and the average value of the three tests was designated as the tensile strength. The value of the 0.2% proof stress obtained by the tensile test was used for the measurement of the stress relaxation ratio described later.

Bending Workability

The 90° W bending test in the case where the bending axis was in the rolling parallel direction (B.W.) was performed by the method described in JIS H3110:2012. The ratio MBR/t of the minimum bending radius MBR that did not cause cracking and the thickness t was obtained.

Stress Relaxation Ratio

The stress relaxation ratio was obtained in such a manner that a test piece having a length of 60 mm in LD and a width of 10 mm in TD was cut out from the test material and subjected to the cantilever stress relaxation test shown in Japan Electronics and Information Technology Industries Association Standards, EMAS-1011. The test piece was set in such a state that a load stress corresponding to a 0.2% proof stress of 80% was applied thereto with the flexural displacement directed to the thickness direction, and the stress relaxation ratio after retaining at 200° C. for 1,000 hours was measured.

The results are shown in Tables 3 and 4.

TABLE 3

| | | After aging treatment | | | |
|---|---|---|---|---|---|
| | | Number density of second phase particles | | | |
| Class | No. | Fine $N_A$ (per 0.12 μm²) | Coarse $N_B$ (per 0.012 mm²) | $N_B/N_A$ | KAM value |
| Example of Invention | 1 | 20.3 | 1.7 | 0.08 | 2.57 |
| | 2 | 11.3 | 3.3 | 0.29 | 2.92 |
| | 3 | 41.8 | 5.6 | 0.13 | 2.13 |
| | 4 | 23.0 | 1.3 | 0.06 | 3.68 |
| | 5 | 12.7 | 2.8 | 0.22 | 3.86 |
| | 6 | 25.0 | 7.3 | 0.29 | 1.92 |
| | 7 | 31.7 | 6.6 | 0.21 | 3.92 |
| | 8 | 21.8 | 2.3 | 0.11 | 3.12 |
| | 9 | 24.0 | 8.3 | 0.35 | 3.72 |
| | 10 | 24.0 | 5.2 | 0.22 | 4.22 |
| Comparative Example | 21 | 12.5 | 7.2 | 0.58 | 1.92 |
| | 22 | 7.3 | 8.1 | 1.11 | 1.63 |
| | 23 | 21.7 | 3.0 | 0.14 | 1.41 |
| | 24 | 7.8 | 1.3 | 0.17 | 4.11 |
| | 25 | 6.5 | 3.3 | 0.51 | 3.02 |
| | 26 | 11.3 | 1.7 | 0.15 | 4.62 |
| | 27 | 14.3 | 2.6 | 0.18 | 5.18 |
| | 28 | 3.3 | 3.9 | 1.18 | 2.98 |
| | 29 | 21.0 | 2.0 | 0.10 | 0.31 |
| | 30 | 12.8 | 2.6 | 0.20 | 1.38 |
| | 31 | 10.7 | 6.7 | 0.63 | 1_21 |
| | 32 | 5.7 | 5.4 | 0.95 | 0.26 |
| | 33 | 13.0 | 7.6 | 0.58 | 1.28 |
| | 34 | — | — | — | — |

TABLE 4

| | | After aging treatment | | | |
|---|---|---|---|---|---|
| Class | No. | Conductivity (% IACS) | Tensile strength (MPa) | Stress relaxation ratio (%) | W bending (MBR/t) |
| Example of Invention | 1 | 82.7 | 503 | 14.1 | 0 |
| | 2 | 86.1 | 458 | 24.6 | 0 |
| | 3 | 84.2 | 528 | 13.8 | 0.3 |
| | 4 | 80.6 | 512 | 16.2 | 0.2 |
| | 5 | 80.2 | 497 | 24.6 | 0 |
| | 6 | 87.6 | 462 | 22.6 | 0.1 |
| | 7 | 80.8 | 536 | 15.9 | 0.3 |
| | 8 | 82.1 | 491 | 17.8 | 0.1 |
| | 9 | 81.6 | 522 | 21.9 | 0.2 |
| | 10 | 83.1 | 513 | 16.4 | 0.1 |
| Comparative Example | 21 | 83.0 | 439 | 24.4 | 0.1 |
| | 22 | 84.6 | 425 | 31.4 | 0.5 |
| | 23 | 83.0 | 445 | 19.3 | 0.1 |
| | 24 | 76.4 | 486 | 38.2 | 0 |
| | 25 | 81.6 | 472 | 27.8 | 0.5 |
| | 26 | 69.8 | 502 | 24.6 | 0 |
| | 27 | 49.8 | 520 | 21.6 | 0.2 |
| | 28 | 83.6 | 457 | 41.3 | 0.3 |
| | 29 | 90.3 | 412 | 38.6 | 0.1 |
| | 30 | 90.2 | 385 | 28.4 | 0 |
| | 31 | 90.1 | 494 | 44.1 | 0.2 |
| | 32 | 93.5 | 528 | 42.3 | 0.2 |
| | 33 | 83.4 | 463 | 36.8 | 0 |
| | 34 | — | — | — | — |

TABLE 5

| Class | No. | Thickness of oxide film on surface of hot rolled sheet (mm) |
|---|---|---|
| Example of Invention | 1 | 0.07 |
| | 2 | 0.06 |
| | 3 | 0.01 |
| Comparative Example | 30 | 0.18 |
| | 31 | 0.22 |

In Examples of the invention, a tensile strength of 450 MPa or more and characteristics of a stress relaxation ratio at 200° C.×1,000 hours were imparted to copper alloy sheet materials having a conductivity of 75.0% or more. The KAM values thereof were in a range of from 1.5 to 4.5, from which it was understood that appropriate crystal lattice strain remained after the aging treatment. In No. 10, recrystallization did not occur in the intermediate annealing in the cold rolling step.

On the other hand, in Comparative Example No. 21, the final rolling pass was completed at a temperature of 550° C. or more according to the hot rolling condition for the ordinary copper alloy, and thus Zr was not precipitated in the crystal grains in the hot rolling step. As a result, Zr was precipitated in a large amount at the crystal grain boundaries and became coarse in the aging treatment, and thus the aged material had a low strength level. In No. 22, the coarse second phase derived from the cast structure remained due to the too low heating temperature in the hot rolling, and thus the strength and the stress relaxation resistance characteristics were deteriorated. In No. 23, the accumulation of strain was insufficient due to the low rolling reduction in the cold rolling, whereby the KAM value was low and the enhancement of the strength was insufficient. In No. 24, the amount of the fine second phase particles formed was insufficient due to the too low aging treatment temperature, and the stress relaxation resistance characteristics were deteriorated. Furthermore, the unprecipitated elements were present in the matrix in a supersaturated state, and the conductivity was deteriorated. In No. 25, Zr was not sufficiently precipitated in the crystal grains in the hot rolling step since the rolling in a temperature range of from 550° C. to 250° C. was not sufficiently performed in the hot rolling, and thus the stress relaxation resistance characteristics were deteriorated. In No. 26 the Sn content was excessive, in No. 27 the Zr content was excessive, and thus the conductivity was deteriorated in these cases. In No. 28, the amount of the Cu—Zr based fine second phase particles was small due to the shortage of the Zr content, and thus the stress relaxation resistance characteristics were deteriorated. In No. 29, since the aging treatment was performed at a relatively high temperature for the composition that did not contain an aging precipitation element other than Zr, the KAM value was decreased due to the release of strain through recrystallization in the aging treatment, and thus the strength and the stress relaxation resistance characteristics were deteriorated. In Nos. 30 and 31, a Cu—Zr based copper alloy containing no Sn was used. These cases are examples where the sufficient accumulation of strain (i.e., the increase of the KAM value) was not achieved through the simple production process including the hot rolling, the cold rolling, and the aging treatment in this order, and thus the strength and the stress relaxation resistance characteristics were not improved simultaneously. In No. 32, since the final pass temperature in the hot rolling was high, and the intermediate annealing causing recrystallization was performed during the cold rolling, the KAM value was decreased, and the strength and the stress relaxation resistance characteristics were not improved in a well balanced manner. In No. 33, since the intermediate annealing causing recrystallization was performed during the cold rolling, the precipitated material became coarse, the KAM value was decreased, and the stress relaxation resistance characteristics were not improved. In No. 34, cracking occurred in the hot rolling due to the too large Zr content, and the subsequent steps were not performed.

As shown in Table 5, the thickness of the oxide film on the surface of the hot rolled sheet was thinner in Examples of the invention containing Sn than the thickness of the oxide film on the surface of the hot rolled sheet in Comparative Examples Nos. 30 and 31 containing no Sn.

The invention claimed is:

1. A copper alloy sheet material having a chemical composition containing, in terms of percentage by mass, from 0.01 to 0.50% of Zr, from 0.01 to 0.50% of Sn, a total content of from 0 to 0.50% of Mg, Al, Si, P, Ti, Cr, Mn, Co, Ni, Zn, Fe, Ag, Ca, and B, with the balance of Cu, and unavoidable impurities, having a metal structure having a number density $N_A$ of first second phase particles, formed mainly of a Cu—Zr based compound and having a particle diameter of the longest portion of the particles in a TEM observation image in a range of from 5 to 50 nm, defined by the following item (A) of 10.0 per 0.12 $\mu m^2$ or more and a value $N_B/N_A$ obtained by dividing numerical part of a number density $N_B$ (per 0.012 $mm^2$) of second second phase particles, formed mainly of a Cu—Zr based compound and having a particle diameter of the longest portion of the particles in a SEM observation image of 0.2 μm or more, defined by the following item (B) by numerical part of the $N_A$ of 0.50 or less, and having a conductivity of 75.0% IACS or more and a tensile strength in a rolling parallel direction (LD) of 450 MPa or more:

(A) in a view field observed with a TEM (transmission electron microscope) equipped with an EDS (energy dispersive X-ray spectrometer) in a thickness direction of the sheet material, a rectangular observation region of 0.4 μm×0.3 μm (area: 0.12 $\mu m^2$) is randomly provided; three positions randomly selected in a Cu parent phase within the observation region are subjected to EDS analysis to measure a detected intensity of Zr, and an average Zr detected intensity of the three positions is designated as $I_0$; in granular substances having contrast different from the parent phase in the TEM image of the rectangular observation region of 0.4 μm×0.3 μm, all the granular substances that are wholly or partially present in the observation region are subjected to EDS analysis under the same condition as in the measurement of $I_0$, and a number of the granular substances that are measured to have a Zr detected intensity 10 times or more the $I_0$ is counted; and the operation is performed for three or more of the rectangular observation regions that do not overlap each other, and a value obtained by dividing the total number counted of the granular substances by the total area of the observation regions is converted to a number per 0.12 $\mu m^2$, which is designated as the number density $N_A$ (per 0.12 $\mu m^2$) of the first second phase particles, (B) a rectangular measurement region of 120 μm×100 μm (area: 0.012 $mm^2$) randomly provided in an observation plane in parallel to a sheet material surface with an FE-EPMA (field emission electron probe micro analyzer) is measured for a fluorescent X-ray detected intensity of Zr (which is hereinafter referred to as a Zr detected intensity with a WDS (wavelength dispersive X-ray spectrometer) under an area analysis condition of an acceleration voltage of 15 kV and a step size of 0.2 μm, the Zr detected intensities of the measured spots are expressed by percentage with the maximum value of the Zr detected intensities within the measurement region being 100%, a binary mapping image is obtained with a black spot for the measured spot having a Zr detected intensity that is less than 50% of the maximum value and a white spot for the measured spot having a Zr detected intensity that is 50% or more of the maximum value, and a number of white regions constituted by only one white spot or two or more white spots adjacent to each other is counted, provided that in a case where a black spot is present within a contour of one white region, the black spot is assumed to be a white spot; and the operation is performed for three or more of the measurement regions that do not overlap each other, and a value obtained by dividing the total number counted of the white regions by the total area of the measurement regions is converted to a number per 0.012 $mm^2$, which is designated as the number density $N_B$ (per 0.012 $mm^2$) of the second second phase particles.

2. The copper alloy sheet material according to claim 1, wherein in an observation plane in parallel to the sheet material surface of the copper alloy sheet material, a KAM (kernel average misorientation) value measured by EBS D (electron backscatter diffractometry) at a step size of 0.2 μm within a crystal grain with a boundary having a crystallographic orientation difference of 15° or more being assumed to be a crystal grain boundary is from 1.5 to 4.5°.

* * * * *